US006324699B1

(12) United States Patent
Cosmah

(10) Patent No.: US 6,324,699 B1
(45) Date of Patent: Dec. 4, 2001

(54) PANTYHOSE UNDERGARMENT WITH CROTCH FLAP

(76) Inventor: Bonnie C. Cosmah, 1780 Timber La., Burlington, KY (US) 41005

( * ) Notice: Subject to any disclaimer, the term of this patent is extended or adjusted under 35 U.S.C. 154(b) by 0 days.

(21) Appl. No.: 09/688,948

(22) Filed: Oct. 16, 2000

Related U.S. Application Data

(60) Provisional application No. 60/161,837, filed on Oct. 27, 1999.

(51) Int. Cl.[7] ..... A41B 11/00

(52) U.S. Cl. ..... 2/239; 2/409; 2/408

(58) Field of Search ..... 2/239, 240, 241, 2/242, 78.2, 408, 409; D2/983

(56) References Cited

U.S. PATENT DOCUMENTS

| | | | | |
|---|---|---|---|---|
| 1,152,484 | * | 9/1915 | Burke . | |
| 1,458,547 | * | 6/1923 | Rood . | |
| 2,016,990 | | 10/1935 | Davis . | |
| 2,477,593 | * | 8/1949 | Gershenow | 2/43 |
| 3,020,556 | | 2/1962 | Isley . | |
| 3,208,454 | | 9/1965 | Farkas . | |
| 3,279,469 | | 10/1966 | Schustack . | |
| 3,362,029 | * | 1/1968 | Comerma | 2/240 |
| 3,974,836 | | 8/1976 | Carlson . | |
| 4,122,555 | | 10/1978 | Safrit et al. . | |
| 4,280,230 | | 7/1981 | LaFleur . | |
| 4,301,550 | * | 11/1981 | Carver | 2/408 |
| 4,597,110 | | 7/1986 | Smith, Sr. et al. . | |
| 4,604,761 | | 8/1986 | Wright . | |
| 4,637,078 | * | 1/1987 | Southwell | 2/408 |
| 4,807,304 | | 2/1989 | McCants-Reed . | |
| 4,951,321 | | 8/1990 | Mortenson et al. . | |
| 4,961,234 | | 10/1990 | Leibman . | |
| 5,239,706 | | 8/1993 | Stevenson . | |
| 5,341,515 | | 8/1994 | Cohen . | |
| 5,533,212 | | 7/1996 | Moretz et al. . | |
| 5,636,387 | | 6/1997 | Lundy . | |
| 5,711,034 | | 1/1998 | Cillik . | |
| 5,717,998 | | 2/1998 | Everett et al. . | |
| 5,790,984 | | 8/1998 | Doubleday . | |
| 5,930,838 | * | 8/1999 | Carter-Scott-Pomije | 2/79 |
| 6,209,143 | * | 4/2001 | Hancock | 2/406 |

FOREIGN PATENT DOCUMENTS

| | | |
|---|---|---|
| 1933947 | 1/1971 | (DE) . |
| 2 281 730 | 12/1976 | (FR) . |

* cited by examiner

*Primary Examiner*—John J. Calvert
*Assistant Examiner*—Alissa L. Hoey
(74) *Attorney, Agent, or Firm*—Wood, Herron & Evans, L.L.P.

(57) ABSTRACT

A pantyhose undergarment having a crotch flap to facilitate urination without lowering the undergarment. A crotch area of the undergarment has an opening which is removably closed with a crotch flap permanently secured to a front of the undergarment and releasably secured about the opening. The crotch flap may be removed to a forward position in which it is not wetted.

5 Claims, 4 Drawing Sheets

PANTYHOSE UNDERGARMENT WITH CROTCH FLAP

CROSS REFERENCE TO RELATED APPLICATIONS

This application claims priority to U.S. provisional patent application serial No. 60/161,837 filed Oct. 27, 1999 entitled "Pantyhose With Crotch Flap".

BACKGROUND OF THE INVENTION

Women wear pantyhose for various reasons: warmth, support, tummy control, body contouring and/or a sleeker, slimmer image.

To acquire the slimmest and most supporting look women wear pantyhose which are as tight as possible. Due to the "tightness" of the fit, pantyhose are difficult to initially put on and take off at the end of the day. During the day, the woman wearing the pantyhose must presumably urinate. This is made difficult because conventional pantyhose are unitary, having no openings. In order to urinate, the woman wearing the pantyhose must struggle to carefully inch the pantyhose down to her ankles before sitting on a toilet to urinate, risking a snag, a run or even a broken nail. Additionally, the inching down process takes time. Having urinated the woman must inch the pantyhose up to their original position. Women do this not just once a day, but many times a day. In hot humid weather, this task is even more troublesome. The hosiery adheres tightly to the skin of the user, making the inching up and down difficult and time-consuming.

Undergarments having openings in the crotch area covered by one or more flaps in order to facilitate urination without lowering the undergannent are known. U.S. Pat. No. 4,807,304 discloses a pantyhose undergarment particularly suited to men which has overlapping flaps which may be separated in order to facilitate urination in the front portion of a torso section of the undergarment.

U.S. Pat. No. 5,533,212 discloses a pantyhose undergarment for women which discloses a panty shield positioned in the crotch area of the wearer in order to wick moisture away from the skin during the garment's wear.

Several undergarments other than pantyhose such as girdles have been modified so as to facilitate urination without needing to lower the undergarment.

U.S. Pat. Nos. 3,279,469 and 3,974,836 disclose undergarments such as girdles having a crotch opening and a flap adapted to cover the opening, the flap being secured to the rear of the undergarment and removably secured to the front of the undergarment such that the wearer of the undergarment may lower the flap for urination purposes. Because the flaps disclosed in these patents hang downwardly from the rear of the crotch opening during urination, it is possible that these flaps may be urinated on or may fall into the fluid inside the toilet.

Therefore, it has been one objective of the present invention to provide an undergarment having a crotch opening and improved flap not subject to such wetting.

It has been a further objective of the present invention to provide a pantyhose undergarment having a crotch opening covered by a flap which may easily be maintained in a position in which it will not be wetted.

SUMMARY OF THE INVENTION

The invention of this application which accomplishes these objectives comprises a pantyhose undergarment having an opening in a crotch area of the pantyhose undergarment between a pair of leg portions of the pantyhose undergarment. A flap is permanently secured to an area of the undergarment at the front of the opening and releasably at the rear of the opening. In this way, the flap can be opened forwardly and grasped by a user who holds it up and out of the way until it is to be reattached. It is thus not free to dangle in a position where it can be wetted. The specific design of the pantyhose undergarment of the present invention facilitates urination by a wearer. The wearer may urinate without having to lower the pantyhose undergarment.

In more detail, the pantyhose undergarment comprises a pair of leg portions and a torso portion above the leg portions, as is conventional with pantyhose. However, the pantyhose undergarment of the present invention has an opening in a crotch area of the pantyhose undergarment.

A crotch flap is permanently secured along a front peripheral portion of the crotch flap to the pantyhose undergarment proximate the opening in the pantyhose undergarment. The crotch flap is removably secured around side and rear peripheral portions of the crotch flap to the pantyhose undergarment with spaced fastener areas. A front peripheral portion of the crotch flap is glued, welded or otherwise permanently secured along a horizontal securement line to a front torso portion of the pantyhose undergarment such that the crotch flap may be held against the lower abdomen of the wearer when urinating.

Although the crotch flap is preferably oval shaped, the crotch flap may be any configuration. The crotch flap may be any size or shape depending upon the size or shape of the opening in the pantyhose undergarment which is removably covered by the crotch flap.

To facilitate urination a user unfastens the fasteners by pulling the crotch flap forwardly between the leg portions of the pantyhose undergarment. Once in front of the wearer the crotch flap may be held against the lower abdomen of the wearer in a position in which the crotch flap will not be urinated upon or fall into the fluid within a toilet.

These and other objects and advantages of the invention of this application will become more readily apparent from the following description of the drawings.

DETAILED DESCRIPTION OF THE DRAWINGS

Figure 1:
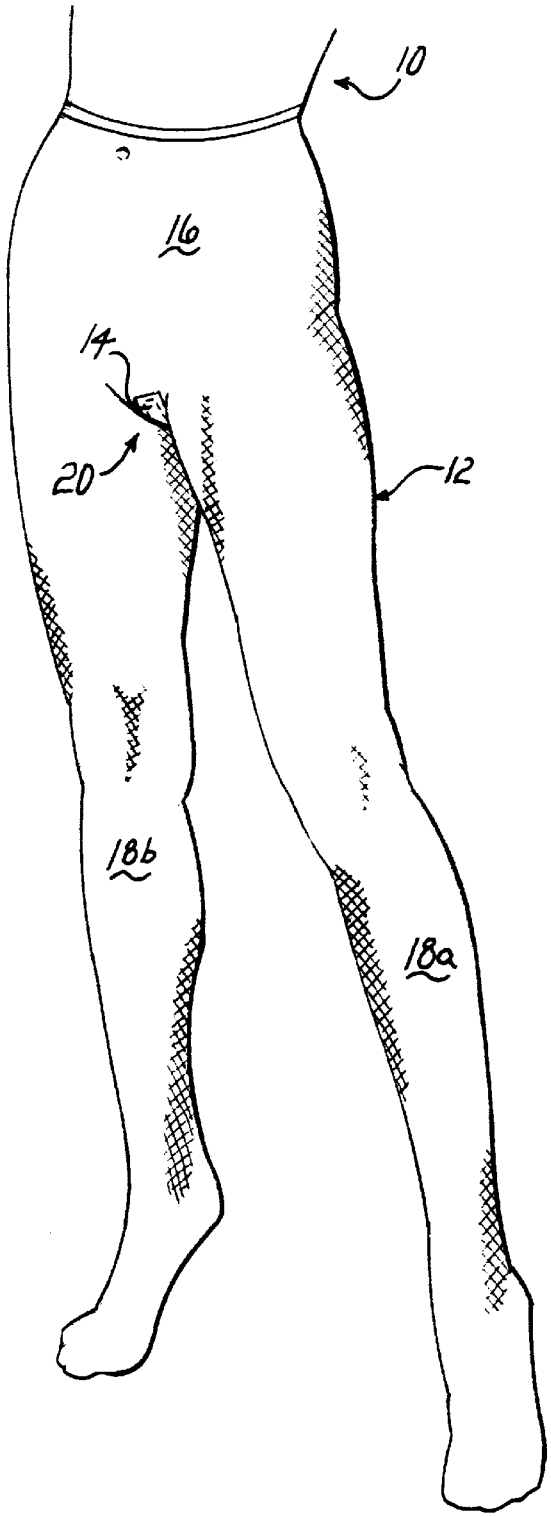
FIG. 1 is a front perspective view of the pantyhose undergarment of the present invention.
Figure 2:
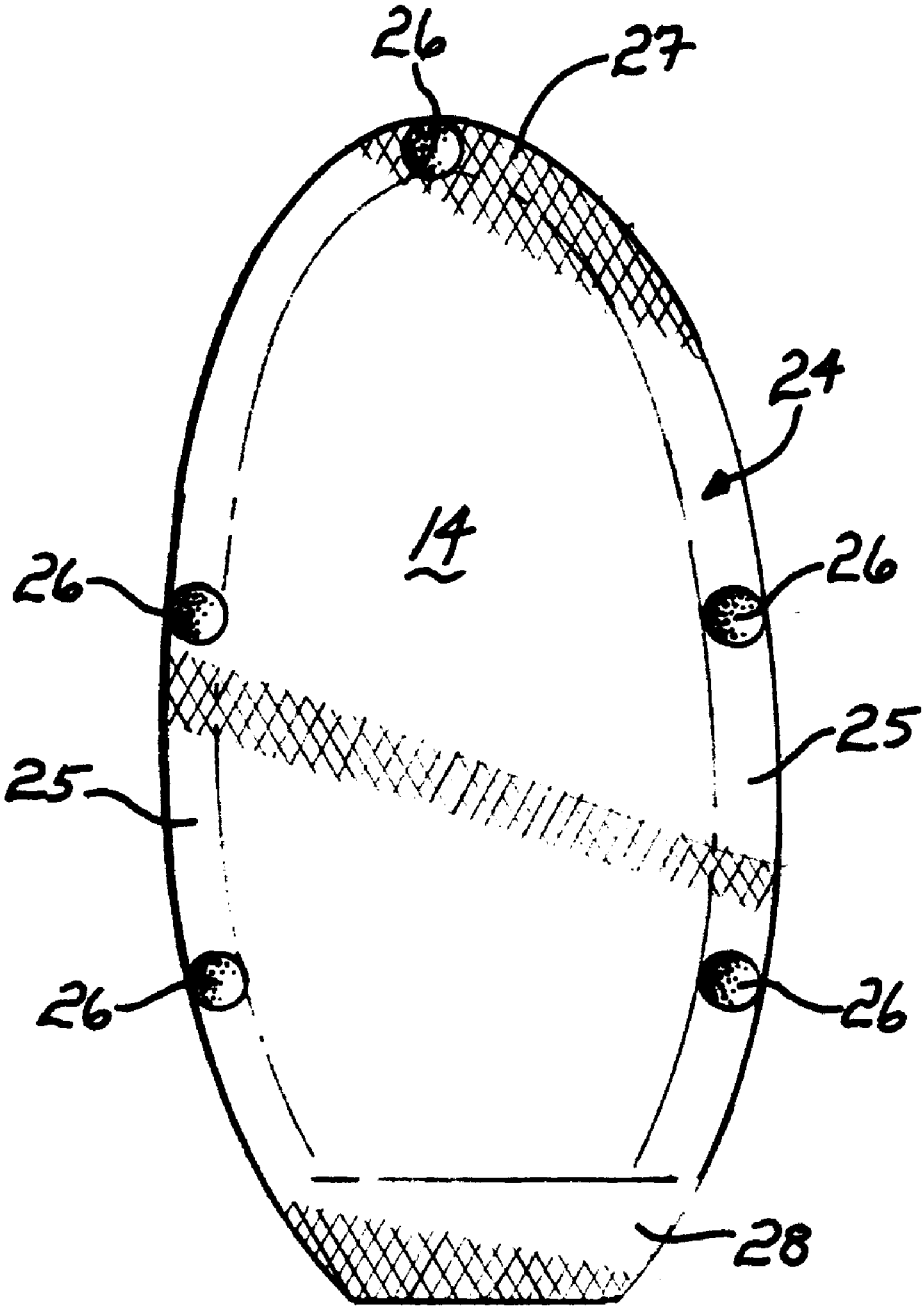
FIG. 2 is a top view of the crotch flap of the pantyhose undergarment illustrating the fastener areas of the flap.

Referring to the drawings and particularly to FIG. 1, there is illustrated a woman 10 wearing a pantyhose undergarment 12 having a crotch flap 14 illustrated in detail in FIG. 2.

The pantyhose undergarment 12 comprises a torso portion 16 adapted to fit around the lower abdomen and torso of the wearer and a pair of leg portions 18*a* and 18*b* extending downwardly from the torso portion. The torso and leg portions may be an integral one-piece unit or may be individual units sewn or otherwise secured together, as is conventional. The leg portions 18 are joined to the torso portion 16 in a crotch area 20 best illustrated in FIG. 4.

The pantyhose undergarment is preferably made of nylon as is conventional but may be made of any other material. In addition, although the pantyhose undergarment is illustrated in FIG. 1 as extending the full length of the legs of the wearer, the pantyhose undergarment may extend downwardly so as to cover only a portion of the legs of the wearer.

Figure 4:
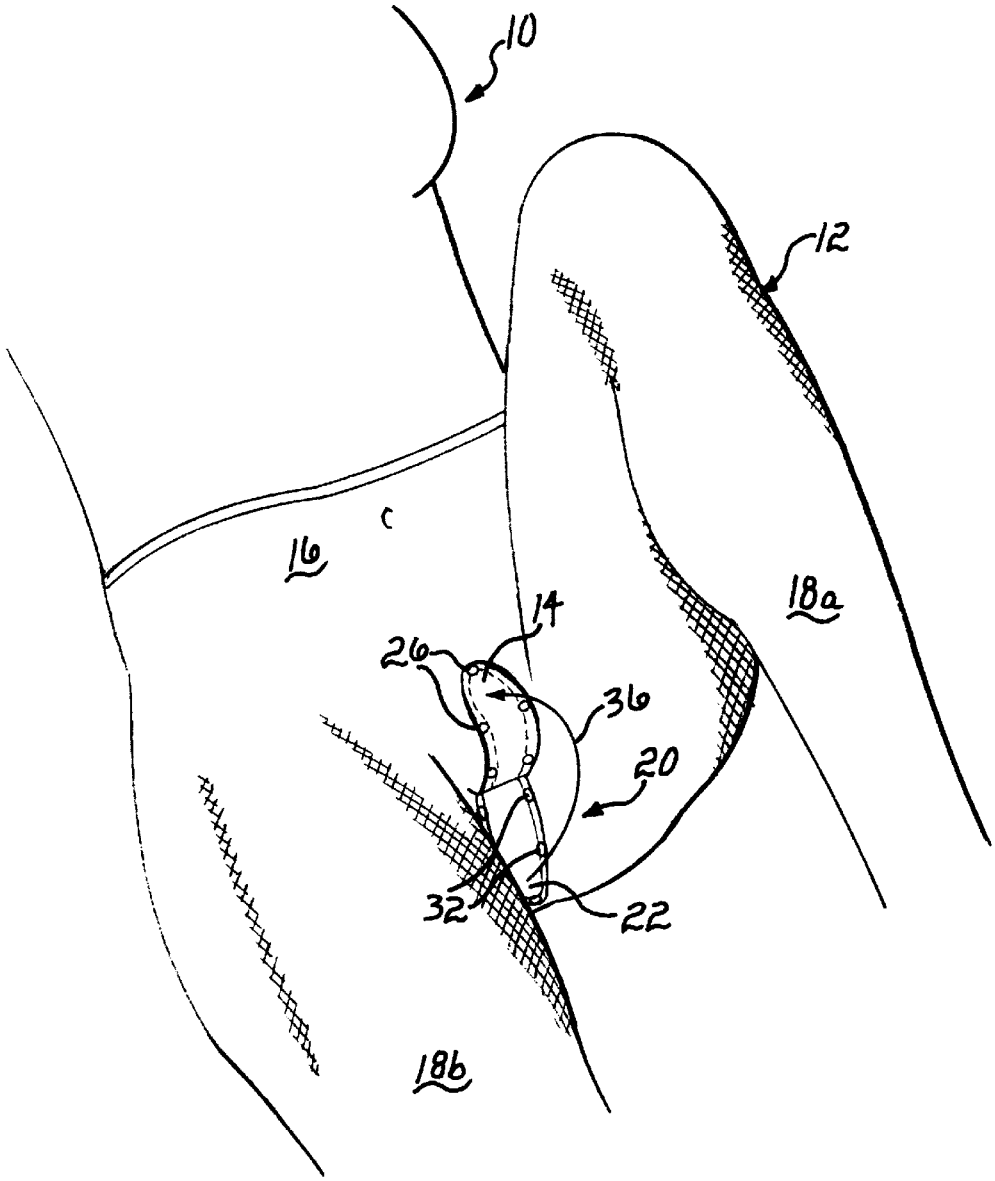
FIG. 4 is a front perspective view of the pantyhose undergarment of FIG. 1 showing the crotch flap being moved upwardly.

The pantyhose undergarment 12 has a n opening 22 best illustrated in FIG. 4 in the crotch area 20 of the pantyhose undergarment 12. The size of the opening 22 will vary depending upon the size of the pantyhose undergarment. In addition the configuration of the opening 22 may vary depending upon the particular application desired. The present application is not intended to limit the size or configuration of the opening in the crotch area of the pantyhose undergarment.

Referring to FIG. 2, there is illustrated a crotch flap 14 having an oval shape with a peripheral portion 24. Although an oval shaped crotch flap 14 is illustrated and described, other shapes and sizes are within the purview of the present invention.

The crotch flap 14 has a plurality of spaced fastener areas 26 extending along side peripheral portions 25 and rear peripheral portion 27 of the crotch flap. One type of fastener which may be used is conventional hook and loop type fasteners such as VELCRO™ although other types of fasteners may be used. Although these fastener areas 26 are illustrated as being dots in FIG. 2, they may alternatively be other configurations such as squares. Alternatively, one continuous piece of fastener may extend around the side and rear peripheral portions of the crotch flap. The crotch flap also has a front peripheral portion 28 which has no fastener areas 26.

The crotch flap 14 is preferably made of cotton but may be made of any other material without departing from the spirit of the invention. In addition, although the crotch flap 14 is illustrated and described as being as being oval shaped, the crotch flap 14 may be any shape. Preferably shape/configuration of the crotch flap 14 and the shape/configuration of the opening 22 in the undergarment are identical, although they may be different shapes or configurations without departing from the spirit of the invention.

The front peripheral portion 28 of the crotch flap 14 is welded or otherwise permanently secured to the front of the torso portion 16 of the pantyhose undergarment proximate the opening 22 in the pantyhose undergarment as best illustrated in FIG. 4.

As illustrated in FIG. 4, proximate the opening 22 in the crotch area 20 of the pantyhose undergarment are a plurality of fastener areas 32 corresponding in size and shape to the fastener areas 26 on the crotch flap 14 such that when the crotch flap 14 is in placed against or folded into a closed position as illustrated in FIG. 1, the fastener areas 26 engage the areas 32 of the undergarment so as to maintain the crotch flap 14 in a closed position.

Figure 3:
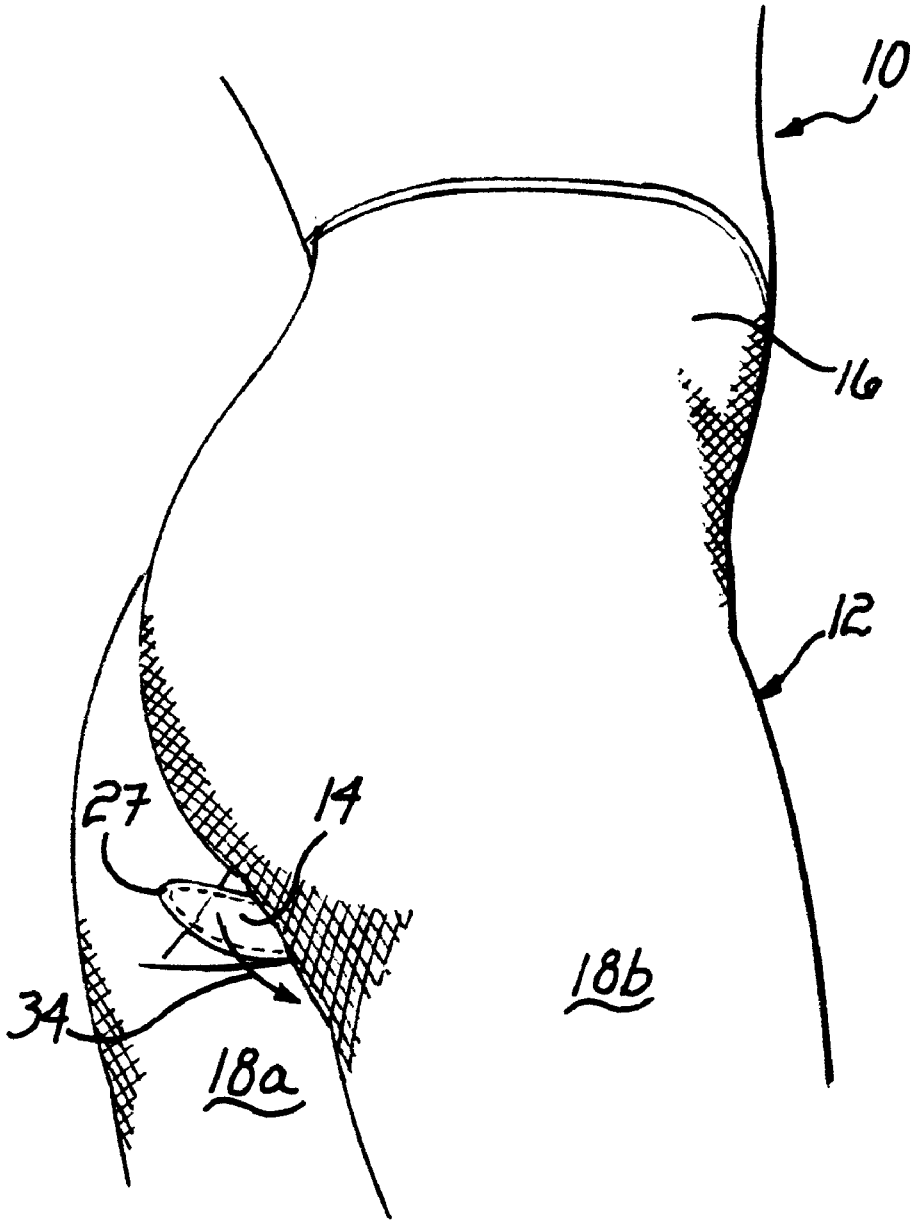
FIG. 3 is a rear perspective view of the pantyhose undergarment of FIG. 1 showing the crotch flap being moved forwardly.

As illustrated in FIG. 3, when the wearer of the undergarment has to urinate, the wearer reaches between his/her legs and pulls the rear peripheral portion 27 of the crotch flap 14 in the direction of arrow 34 forwardly between the leg portions 18*a*, 18*b* of the pantyhose undergarment. The fastener areas 26 separate from the fastener areas 32 of the undergarment. Once the crotch flap 14 is passed between the leg portions of the undergarment, the crotch flap 14 is pulled upwardly in the direction of arrow 36 illustrated in FIG. 4 to a raised position in which it may be held above and away from the opening 22 in the pantyhose undergarment to facilitate urination.

In its raised position, the crotch flap 14 will not interfere with urination and will not fall into the toilet bowl. Once the wearer is done urinating, the wearer will lower the crotch flap 14 to its closed position in which the fastener areas 26 contact or engage the areas 32 of the undergarment, thus maintaining the crotch flap 14 in a closed position in which it covers the opening 22.

While I have disclosed one preferred embodiment of the present invention, other changes and modifications known to those skilled in the art may be made without departing from the spirit of this invention. Therefore, I do not intend to be limited except by the scope of the following claims.

What is claimed is:

1. A pantyhose undergarment having a crotch flap to facilitate urination without lowering the pantyhose undergarment, said pantyhose undergarment having an opening in a crotch area of the pantyhose undergarment between leg portions of the pantyhose undergarment, a crotch flap permanently secured along a front peripheral portion of the crotch flap to the pantyhose undergarment proximate the opening in the pantyhose undergarment, said crotch flap being removably secured around side and rear peripheral portions of the crotch flap to the pantyhose undergarment with spaced fastener areas such that the crotch flap is openable from the undergarment in a forward direction towards a front waist portion of a wearer for maintaining the crotch flap in a forward position proximate a front portion of the undergarment.

2. The pantyhose undergarment of claim 1 wherein said spaced fastener areas are areas of hook and loop fasteners.

3. The pantyhose undergarment of claim 1 wherein said spaced fastener areas are circular.

4. A method of facilitating urination while wearing a pantyhose undergarment, said pantyhose undergarment having an opening in a crotch area of the pantyhose undergarment between leg portions of the pantyhose undergarment and a crotch flap permanently secured along a front peripheral portion of the crotch flap to the pantyhose undergarment proximate the opening in the pantyhose undergarment, said crotch flap being removably secured around side and rear peripheral portions of the crotch flap to the pantyhose undergarment with spaced fastener areas, said method comprising:

unfastening the fastener areas by pulling the crotch flap forwardly between the leg portions of the pantyhose undergarment towards a wearer's navel, and holding the crotch flap above the opening in front of the pantyhose undergarment during urination.

5. A pantyhose undergarment having a crotch flap to facilitate urination without lowering the pantyhose undergarment, said pantyhose undergarment having an opening in a crotch area of the pantyhose undergarment between leg portions of the pantyhose undergarment, a crotch flap permanently secured along a front peripheral portion of the crotch flap to the pantyhose undergarment proximate the opening in the pantyhose undergarment, said crotch flap being removably secured around side and rear peripheral portions of the crotch flap to the pantyhose undergarment with spaced fastener areas such that the crotch flap is openable from the undergarment in a forward direction towards a wearer's navel for maintaining the crotch flap in a forward position proximate a front portion of the undergarment.

* * * * *